US006681778B1

(12) United States Patent
Salisbury et al.

(10) Patent No.: US 6,681,778 B1
(45) Date of Patent: Jan. 27, 2004

(54) HAIR CLIP

(75) Inventors: Shelley-Anne Salisbury, London (GB); Lindsey J. Walker, London (GB)

(73) Assignee: Linshell Holdings Limited, London (GB)

( * ) Notice: Subject to any disclaimer, the term of this patent is extended or adjusted under 35 U.S.C. 154(b) by 7 days.

(21) Appl. No.: 10/295,835

(22) Filed: Nov. 18, 2002

(51) Int. Cl.[7] ..... A45D 8/20
(52) U.S. Cl. ..... 132/277; 132/275
(58) Field of Search ..... 132/277, 273, 132/275; 24/67.7, 493, 496, 507, 503, 515; D28/39, 40, 41, 42, 43

(56) References Cited

U.S. PATENT DOCUMENTS 67,100 A * 7/1867 Brinkerhoff ..... 24/515
1,429,182 A * 9/1922 Ashley ..... 24/515
2,155,616 A * 4/1939 Rilling ..... 132/277
2,163,824 A * 6/1939 Bacon ..... 132/277
4,557,503 A * 12/1985 Linn ..... 24/515
5,570,500 A * 11/1996 Merkel ..... 24/515
5,791,024 A * 8/1998 Jovanovich ..... 24/503
5,862,815 A 1/1999 Murphy et al.
5,988,184 A * 11/1999 Shu ..... 132/277
6,003,522 A * 12/1999 Schach ..... D28/42
6,035,863 A * 3/2000 Mao ..... 132/273
6,135,125 A 10/2000 Sartena
6,142,159 A 11/2000 Lloyd
6,186,151 B1 * 2/2001 Newlin ..... 132/273
6,257,249 B1 * 7/2001 Thomas et al. ..... 132/273

* cited by examiner

*Primary Examiner*—Todd E. Manahan
(74) *Attorney, Agent, or Firm*—Dickstein Shapiro Morin & Oshinsky, LLP

(57) ABSTRACT

A hair clip comprises a body, jaws mounted on the body and a jaw opening arrangement to allow the jaws to be opened single handed. The jaws have tines and are mounted at spaced positions on the body so as to be pivotable at the positions to resiliently grip hair in the tines. The spacing of the pivot positions on the body enables a body to be used which can be decorated or hollow to enhance the aesthetics of the hair clip.

73 Claims, 6 Drawing Sheets

HAIR CLIP

FIELD OF THE INVENTION

The present invention generally relates to hair clips and more particularly to hair clips having pivotable jaws for gripping hair.

BACKGROUND OF THE INVENTION

One type of prior art clips which use pivotable jaws are generally known as butterfly clips. These clips comprise two jaw members having tines and being joined along a pivot axis. A spring arrangement is provided at the pivot axis to resiliently urge the tines of the jaws to a closed position to grip the hair. To enable the tines to be disengaged and the jaws opened, the jaws are provided with lever members extending therefrom at a position away from the tines. This gives the clip the classic 'butterfly' appearance and hence its common name. When the clips are worn the primary visible parts are the lever members or 'wings' and the joining pivot and spring mechanism. The problem is that although these clips are easy to use single handed, the spring and pivot mechanism is not very aesthetically appealing. The arrangement disclosed in U.S. Pat. No. 5,862,815 addresses this problem by providing a cover over the spring mechanism. This cover is however required to flex or fold as the clip is opened and the wings close together. Thus the cover mechanism is complex to build and is fragile and thus liable to failure in use, especially as the clip ages.

Another type of clip which provides pivotable jaws is disclosed in U.S. Pat. No. 6,142,159. This clip comprises a barrette made of a single flat strip of resilient material. Ends of the flat strip form tines that join when in the closed position. In one example the clip can be opened by pulling the two ends apart. This operation requires the use of two hands and is thus more complex than that required for opening butterfly clips. In another example in U.S. Pat. No. 6,142,159 handle portions are provided and the strip flexes in a central region. While this enables single handed operation, it requires the central region to be flexible. This limits the decorative ability of the central region.

It is thus an object of the present invention to provide an improved hair clip that overcomes the deficiencies in the prior art.

SUMMARY OF THE INVENTION

One aspect of the present invention provides jaw arrangements having tines, and a body arrangement to which the jaw arrangements are pivotably and resiliently mounted so as to urge the jaw arrangements to a closed position where said tines meet. A jaw opening arrangement is provided to allow the jaw arrangement to be opened single handed. The jaw arrangements are mounted on the body arrangement at pivot positions which define laterally spaced pivot axes.

By laterally spacing the pivot axes it is possible to use a body which can be decorated or made less visible and can also act to hide the pivot mechanisms if necessary, thereby improving the aesthetic appearance of the clip in use.

The present invention includes any body arrangement such as a single body part or multiple body parts acting to hold the effective pivot points of the jaw arrangements spaces laterally. Also the jaw arrangements can comprise any arrangement of single or multiple jaw parts. Where multiple jaw parts are provided, the jaw parts can be pivotable connected together to form a multiply pivoted jaw arrangement. Pivots in such an arrangement will lie substantially parallel. The jaw opening arrangement can comprise any suitable part or collection of parts to enable the jaw arrangements to be urged pivotably to an open position against the resilient force of the resilient connection between the jaw arrangements and the body arrangement.

In one embodiment of the present invention, the body arrangement has an outer face and the pivot mechanisms are arranged on said body arrangement away from the outer face. Thus the pivot mechanisms are hidden in the hair when worn.

In an embodiment of the present invention, the opening arrangement comprises handle portions extending from said jaw arrangements at positions away from the tines and acting as lever members to lever the jaw arrangements open about the pivots.

In an alternative embodiment, the opening arrangement comprises an engagement member arranged within the jaws arrangements and operable in a direction of the pivot axes to engage the jaw arrangements to urge them open. In this embodiment the jaw engagement portion can have angled engagement surfaces for engagement with the jaw arrangements to urge them open. Also the jaw engagement portion can be carried by the body arrangement. For example the jaw engagement portion can be slidably attached to said body portion to allow said jaw engagement portion to slide relative to said body portion to engage said jaw portions.

In another embodiment of the present invention, resilient portions are arranged between the body arrangement and the jaw arrangement to provide the resilient connection between the body arrangement and the jaw arrangement. In this embodiment the jaw portions can be mounted to the body arrangement via pivot pins, and the resilient portions can comprise spring members engaging the body arrangement and the jaw arrangements. In an alternative embodiment of the present invention, the jaw portions are formed from the same piece of material as said body portion and at pivot points the material is thinned in section to enable the jaw portions to pivot relative to the body portion, and a resilient member is provided to urge the jaw arrangements to the closed position. In another alternative embodiment of the present invention the resilient portions comprise resilient material connecting the jaw arrangements and the body arrangement.

In another embodiment of the present invention, the body arrangement comprises a base portion to which the jaw arrangements are connected, and at least one decorative cover portion. In this embodiment at least one said decorative cover portion can be removable in use to enable different cover portions to be connected to the base portion.

In another embodiment the body is formed of thin section edge regions defining a central aperture through the body between the pivot axes. Thus in this embodiment the hair of the wearer can be seen through the body thus reducing the visibility of the clip.

In one embodiment of the present invention, the jaw portions are arcuate in section to define a volume between the body arrangement and the jaw arrangements into which hair can be clasped in use.

In one embodiment of the present invention each jaw arrangement comprises a plurality of hingedly and resiliently coupled jaw sections, each hinged coupling lying along an axis parallel to the laterally spaced axes.

DESCRIPTION OF EMBODIMENTS OF THE INVENTION

Figure 1:
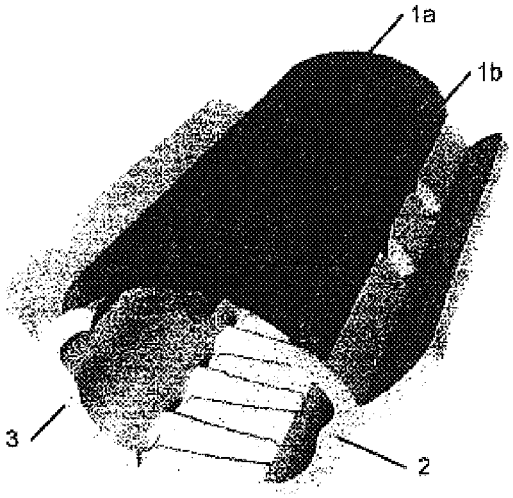
FIG. 1 is a perspective diagram of a hair clip of a first embodiment of the present invention.
Figure 2:
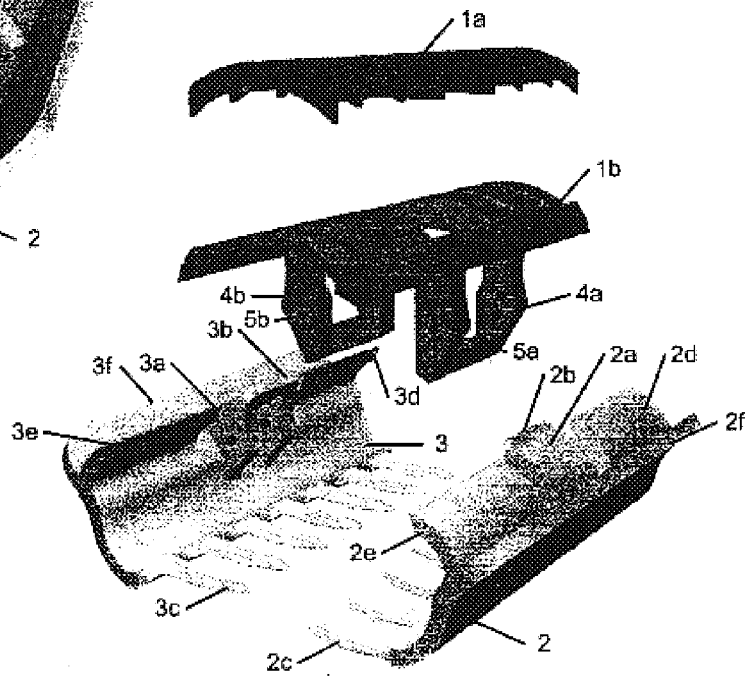
FIG. 2 is an exploded view of the hair clip of the first embodiment of the present invention.
Figure 3:
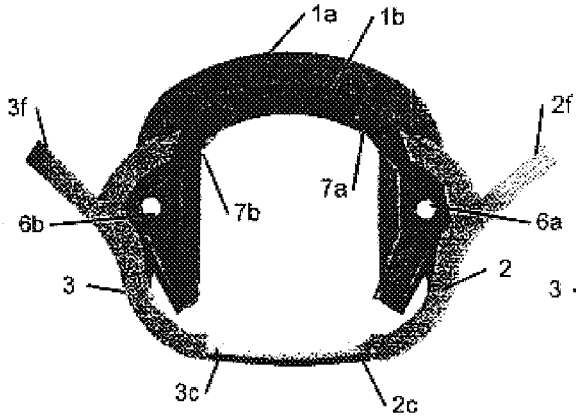
FIG. 3 is a cross sectional view through the hair clip of the first embodiment of the present invention in the closed position.
Figure 4:
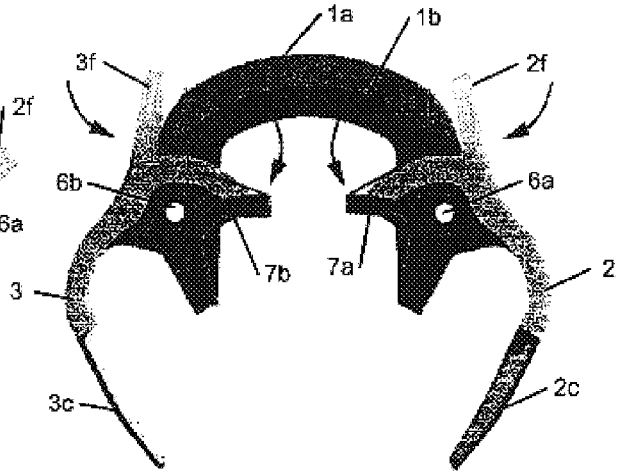
FIG. 4 is a cross sectional view through the hair clip of the first embodiment of the present invention in the open position.
Figure 5:
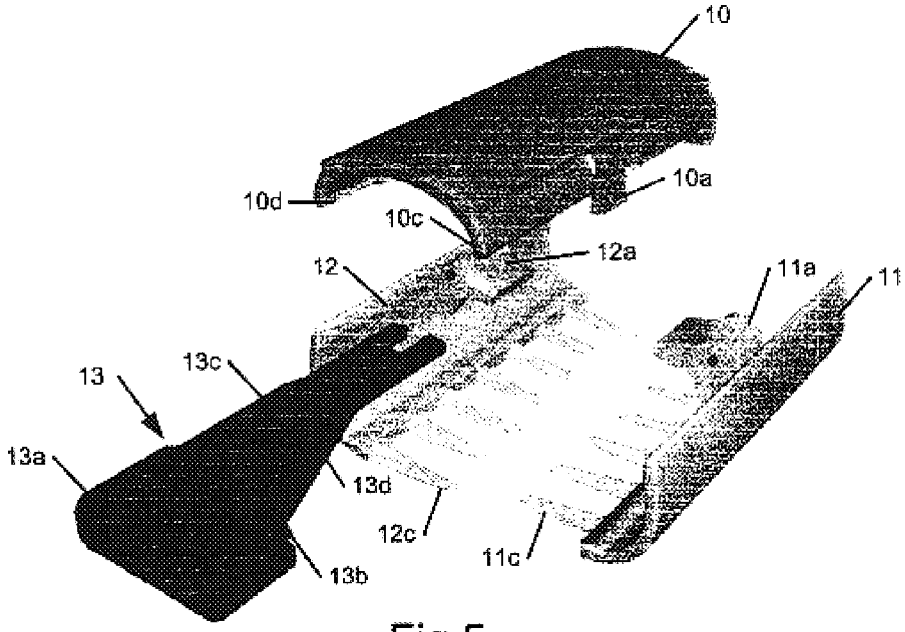
FIG. 5 is an exploded view of the hair clip of a second embodiment of the present invention.
Figure 6:
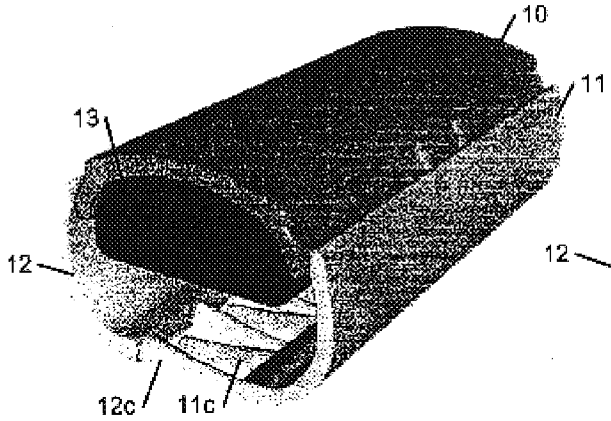
FIG. 6 is a perspective diagram of a hair clip of the second embodiment of the present invention.
Figure 7:
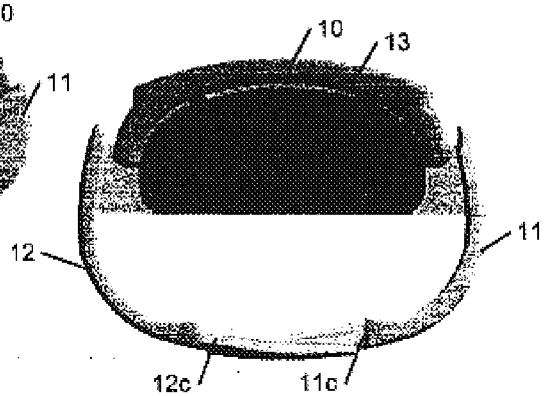
FIG. 7 is an end view of the hair clip of the second embodiment of the present invention.
Figure 8:
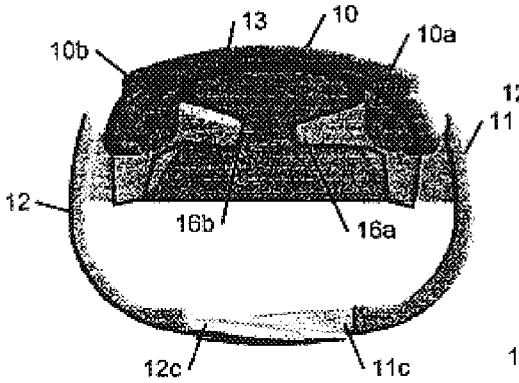
FIG. 8 is a cross sectional view through the hair clip of the second embodiment of the present invention in the closed position.
Figure 9:
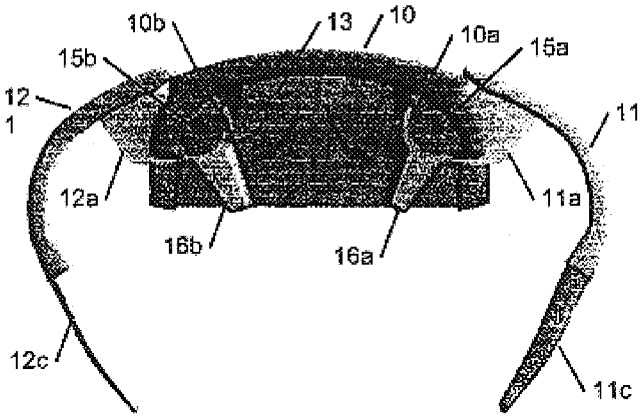
FIG. 9 is a cross sectional view through the hair clip of the second embodiment of the present invention in the open position.
Figure 10:
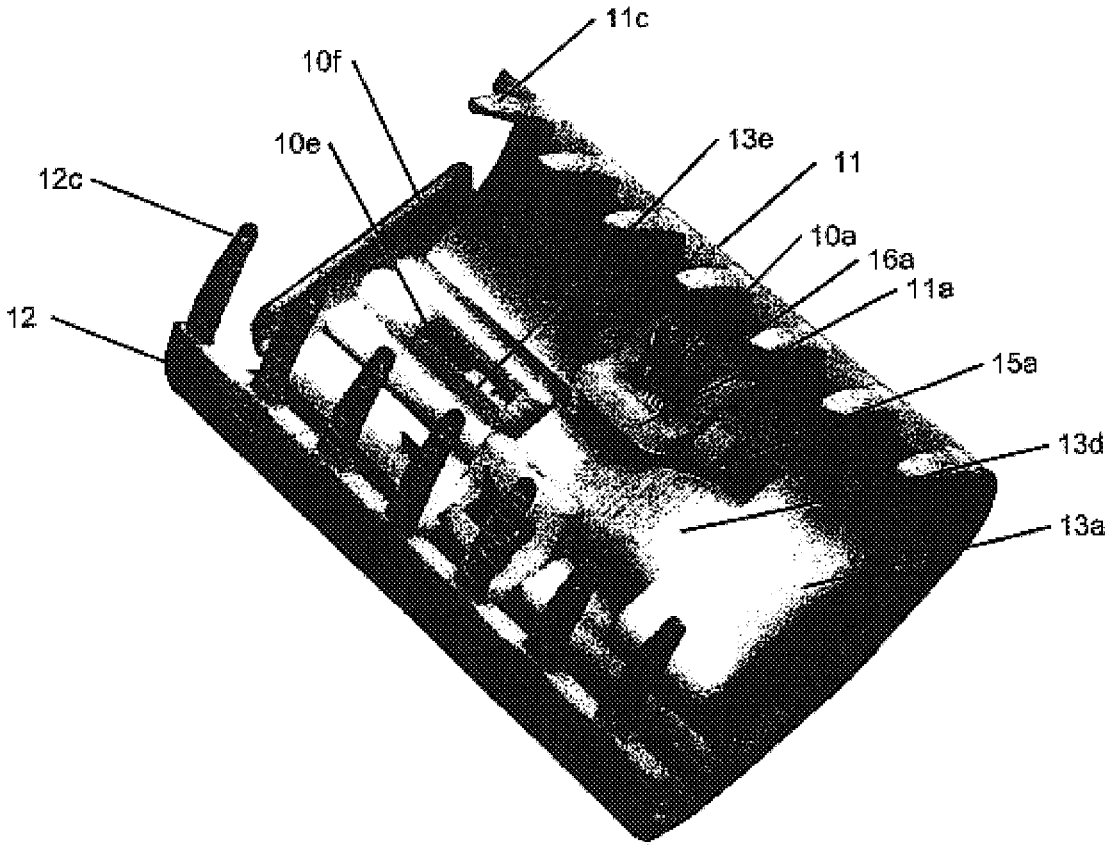
FIG. 10 is a perspective view of the hair clip of the first embodiment of the present invention showing the inside of the hair clip in the open position.

A first embodiment of the present invention will now be described with reference to FIGS. 1 to 4.

The hair clip of this embodiment comprises a body 1 formed of a base 1*a* and a cover 1*b* which is coupled to the base 1*a*. The decorative cover can either be detachable in use to enable the cover to be changed, or it can only be fixed. The fixed cover enables the fixing of different covers to the same base 1*a* during the manufacturing process. The base 1*a* has an elongate arcuate carrying surface for carrying the decorative cover 1*b* in an elongate arcuate shape. Below the carrying surface there are provided two arms 4*a* and 4*b* extending away from the base 1*a* at spaced positions to the sides of the base 1*a*. The arms 4*a* and 4*b* have pivot holes 5*a* and 5*b* for receiving pivot pins 6*a* and 6*b*.

Two opposed elongate jaws 2 and 3 have a curved or roughly arcuate cross section. A pivot arm 2*a* and 3*a* respectively extends inwardly from an upper edge of each jaw 2 and 3 and has a pivot hole for receiving the respective pivot pin 6*a* and 6*b*. In this way the jaws 2 and 3 are mounted on the base 1*a* to pivot about pivot axes spaced from one another. The pivot arms 2 and 3 have an upper lip 2*b* and 3*b* respectively which serves to limit the closed position of the jaws 2 and 3 by engaging with an inner surface of the base 1*a* Cover portions 2*d* and 2*e*, and 3*d* and 3*e* extend from the upper edges of the jaws 2 and 3 parallel to the pivot arms to bridge the gap between the jaws 2 and 3 and the base 1*a* when the jaws are in the closed position. Along one edge of the jaws 2 and 3 away from the pivot arms 2*a* and 3*a* and cover portions 2*d*, 2*e*, 3*d* and 3*e* respectively tines 2*c* and 3*c* respectively extend towards one another for gripping hair. In the closed position the tines 2*c* and 3*c* of the jaws 2 and 3 interlace. The jaws 2 and 3 are also provided with handle portions or 'wings' 2*f* and 3*f* which extend along the body of the jaws 2 and 3 and extend therefrom at a position away from the tines 2*c* and 3*c* near the top edges of the jaws 2 and 3. The handle portions 2*f* and 3*f* are arranged above the pivot point so that they can be held between the fingers of a hand and squeezed to urge the jaws 2 and 3 to the open position.

Also mounted on the pivot pins 6*a* and 6*b* are springs 7*a* and 7*b* having spring arms for engaging the arms 4*a* and 4*b* and the pivot arms 2*a* and 3*a* to urge them apart and thereby urge the jaws 2 and 3 to the closed position.

It can be seen that in this embodiment the jaws 2 and 3 are pivoted on laterally separated pivot positions either side of the body 1 so that the pivot mechanisms are hidden under the body 1. Thus the body 1 can be decorated to improve the aesthetic appearance of the hair clip. The appearance can also be changed as desired in this embodiment by changing the cover 1*a*.

A second embodiment of the present invention will now be described with reference to FIGS. 5 to 10. This embodiment is similar to the first embodiment except that the jaw opening arrangement is different.

The hair clip of this embodiment comprises a body 10 having an elongate arcuate decorative outer surface. Below the decorative surface there are provided two arms 10*a* and 10*b* extending away from the body 10 at spaced positions to the sides of the body 10. The arms 10*a* and 10*b* have pivot holes for receiving pivot pins 15*a* and 15*b*.

Two opposed elongate jaws 11 and 12 have a curved or roughly arcuate cross section. A pivot arm 11*a* and 12*a* respectively extends inwardly from an upper edge of each jaw 11 and 12 and has a pivot hole for receiving the respective pivot pin 15*a* and 15*b*. In this way the jaws 11 and 12 are mounted on the body 10 to pivot about pivot axes spaced from one another. Along one edge of the jaws 11 and 12 away from the pivot arms 11*a* and 12*a* respectively tines 11*c* and 12*c* respectively extend towards one another for gripping hair. In the closed position the tines 11*c* and 12*c* of the jaws 11 and 12 interlace.

An opening member 13 is provided for engaging and opening said jaws 11 and 12. The body 10 is provided with ridges 10*c* and 10*d* extending along inner edges and an engagement slot 10*e* on an inner face of the body for engagement by the opening member. The body 10 is also provided with an end plate 10*f* extending from one end of the inner face near the engagement slot 10*e*. The opening member 13 comprises a main portion 13*a* having a section shaped to fit in the inner surface of the body 10 and grooves 13*b* in the sides to ride along the ridges 10*c* and 10*d* of the body 10 so that the opening member 13 can slide laterally along the body 10. The opening member 13 also has an arm portion 13*c* extending from the body portion 13*a*. The arm portion 13*c* has a sloping surface 13*d* for engagement with the pivot arms 11*a* and 12*a* of the jaws to urge the jaws 11 and 12 open. The opening member 13 includes a latch member 13*e* at the end of the arm portion for engaging the engagement slot 10*e* in the body 10 to prevent the opening member 13 detaching from the body 10. A single handed operation to open the clip involves holding the hair clip in one hand and squeezing the opening member 13 and the end plate 10*f* with the fingers and thumb of the hand.

Also mounted on the pivot pins 15*a* and 15*b* are springs 16*a* and 16*b* having spring arms for engaging the arms 10*a* and 10*b* and the pivot arms 11*a* and 12*a* to urge them apart and thereby urge the jaws 11 and 12 to the closed position. The opening member 13 is operable to act against the springs 15*a* and 15*b*.

It can be seen that in this embodiment the jaws 11 and 12 are pivoted on laterally separated pivot positions either side of the body 10 so that the pivot mechanisms are hidden under the body 10. Thus the body 10 can be decorated to improve the aesthetic appearance of the hair clip.

In this embodiment, although the face 13*d* of the opening member 13 that engages the arms 4*a* and 4*b* is flat, the face can be any suitable shape to enhance the application of an opening force on the arms 4*a* and 4*b*. For example, the face can be formed or two opposed sloping faces to provide a triangular cross section.

Figure 11:
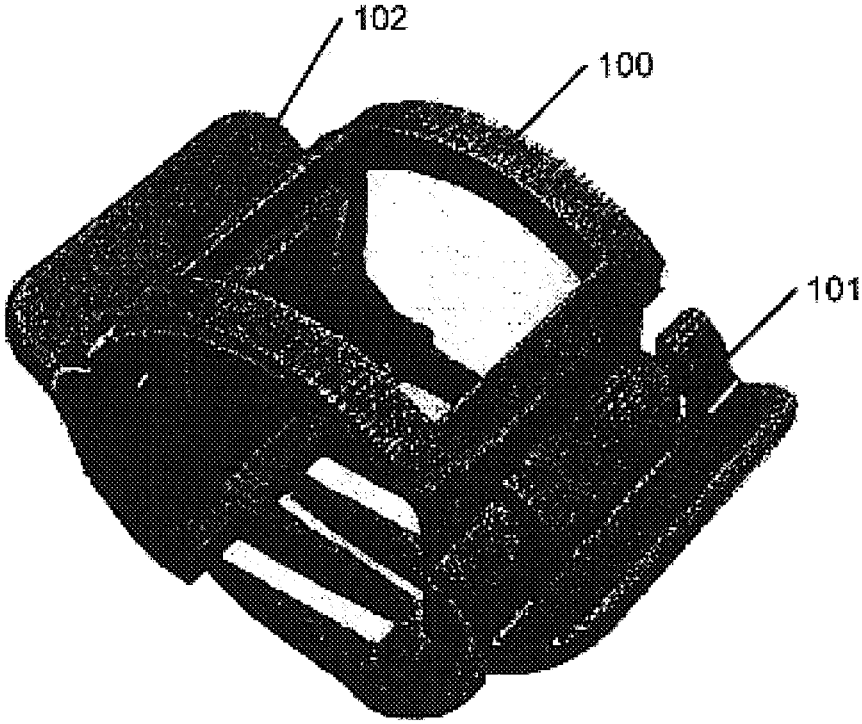
FIG. 11 is a perspective diagram of a hair clip of a third embodiment of the present invention.
Figure 12:
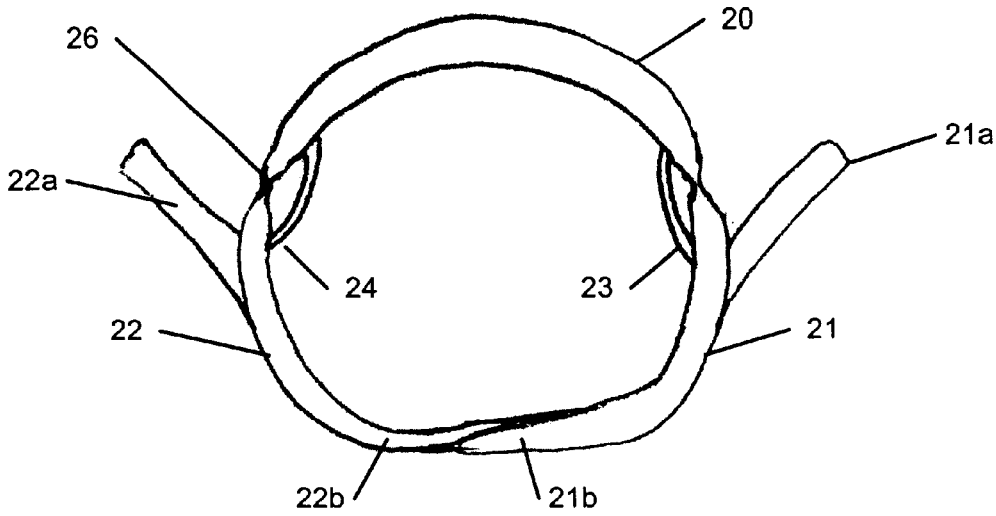
FIG. 12 is a schematic cross section through a hair clip of a fourth embodiment of the present invention.

A third embodiment of the present invention will now be described with reference to FIG. 11. This embodiment is similar to the first embodiment except that the hair clip is shorter and the body 100 has a large aperture in it.

The body 100 in this embodiment is formed of thin section material forming an aperture between the two pivot axes on which the jaws 101 and 102 pivot. Thus in this embodiment when the clip is worn the wearers hair can be seen through the aperture. This reduces the visibility of the clip. Also since the pivot mechanisms for the jaws are mounted on the lower or inside of the clip, the mechanisms are hidden by the wearer's hair in use.

In this embodiment a cover can be provided to be detachably attached to the body 100 to cover the aperture. This enables the wearer to select whether or not to have a decorative cover and also to choose which decorative cover to use.

A fourth embodiment of the present invention will now be described with reference to FIG. 112. This embodiment is similar to the first embodiment except that the pivotable mounting of the jaws on the body is formed by thinning a section of material.

The hair clip of this embodiment comprises a body 20 having an elongate arcuate carrying surface. Either side, along the elongate edges of the body 20 the body is connected to two jaws 21 and 22. The connection is formed by regions 25 and 26 of thinning of the material between the jaws 21 and 22 and the body 20. This forms a hinge or pivot point extending along the edges of the body 20. Thus the body 20 and the jaws 21 and 22 can be formed of the same material e.g. a plastic material having a thin region therebetween. Alternatively the body 20 and the jaws 21 and 22 can be formed in three pieces and joined by connection of a thin section region of one to the other.

Within the jaws 21 and 22 and the body springs or resilient members 20 provide the resilient force to urge the jaws 21 and 22 to the closed position. The jaws 21 and 22 are provided with handle portions 21*a* and 22*a* to enable to one handed operation of the hair clip. Also the jaws 21 and 22 have tines 21*b* and 22*b* for gripping hair.

Thus in this embodiment the lateral displacement of the pivot axes of the jaws enable a decorative body to be used while still enabling single handed operation. The pivot mechanism is displaced to either side of the decorative body.

Figure 13:
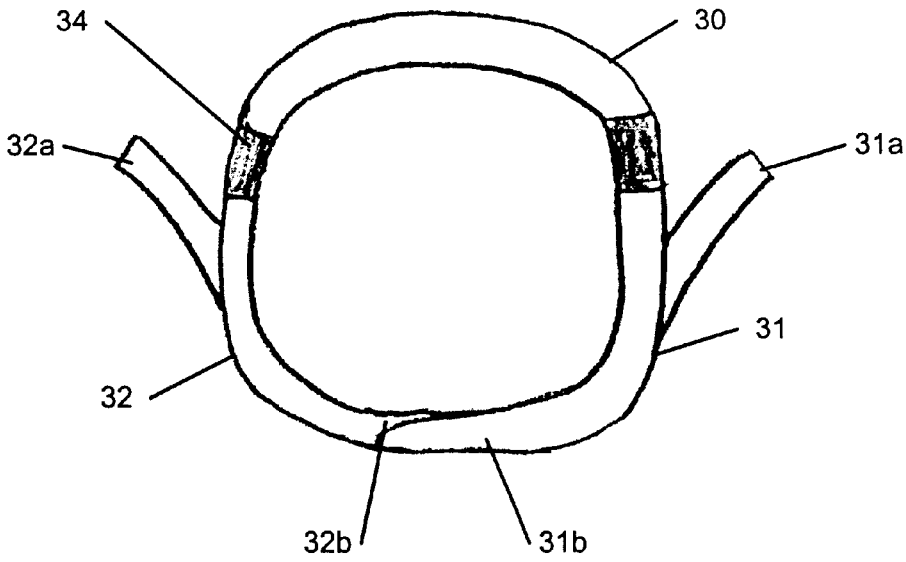
FIG. 13 is a schematic cross section through a hair clip of a fifth embodiment of the present invention.

A fifth embodiment of the present invention will now be described with reference to FIG. 13. This embodiment is similar to the fourth embodiment except that the pivotable mounting of the jaws on the body is formed by regions or resilient material interconnecting the jaws and the body.

The hair clip of this embodiment comprises a body 30 having an elongate arcuate carrying surface. Either side, along the elongate edges of the body 30 the body is connected to two jaws 31 and 32. The connection is formed by regions of resilient material 33 and 34 between the jaws 31 and 32 and the body 30. This forms a hinge or pivot point extending along the edges of the body 30. Thus the body 30 and the jaws 31 and 32 are formed in three pieces and joined by connection of a resilient section of material 33 and 34.

The jaws 31 and 32 are provided with handle portions 31*a* and 32*a* to enable to one handed operation of the hair clip. Also the jaws 31 and 32 have tines 31*b* and 32*b* for gripping hair.

Thus in this embodiment the lateral displacement of the pivot axes of the jaws enable a decorative body to be used while still enabling single handed operation. The pivot mechanism is displaced to either side of the decorative body.

Figure 14:
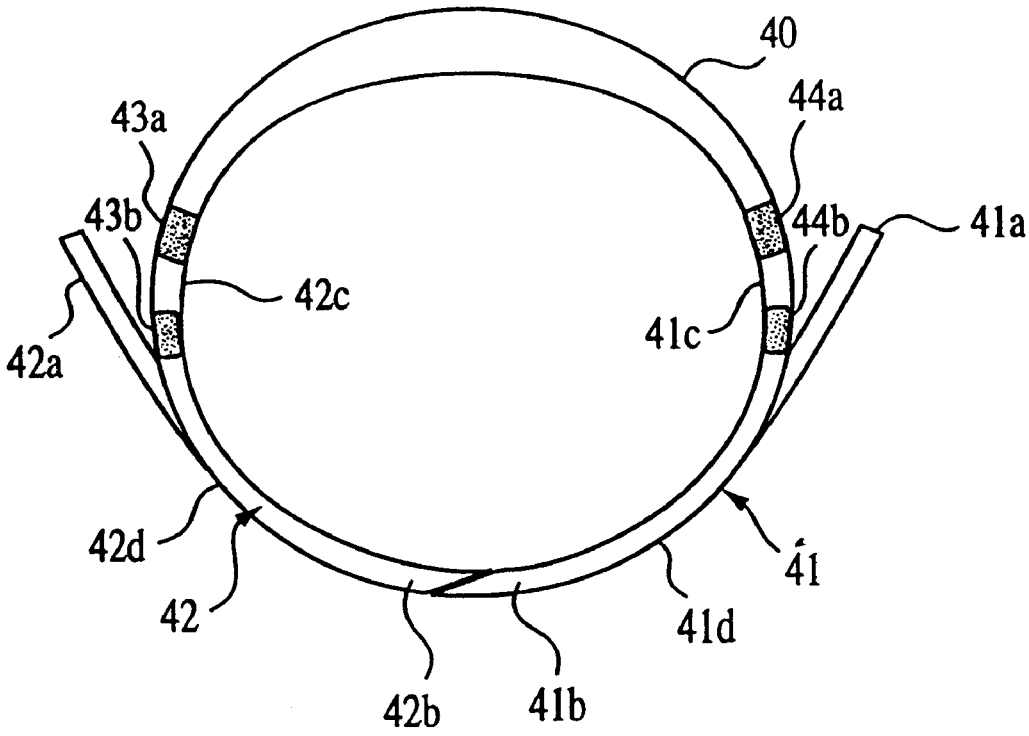
FIG. 14 is a schematic cross-section through a hair clip of a further embodiment of the present invention similar to the fifth embodiment except that the jaws are formed of a plurality of sections.

FIG. 14 illustrates a further embodiment of the present invention. This embodiment is similar to the fifth embodiment except that the jaws 41 and 42 are formed of a plurality of jaw sections 41*c*, 41*d*, 42*c* and 42*d*.

The hair clip of this embodiment comprises a body 40 having an elongate arcuate carrying surface. Two jaws 41 and 42 are hingedly and resiliently arranged either side of the body 40 along the elongate edges of the body 40. The jaws 41 and 42 are formed of a plurality of jaw sections 41*c*, 41*d*, 42*c* and 42*d*. The first jaws sections 41*c* and 42*c* are hingedly connected to the body 40 by a resilient section of material 44*a* and 43*a* respectively. The second jaw sections 41*d* and 42*d* are hingedly connected to the first jaw sections 41*c* and 42*c* by a resilient section of material 44*b* and 43*b* respectively. Handle portions 41*a* and 42*a* are provided extending from the second jaw sections 41*d* and 42*d* and tines 41*b* and 42*b* are provided on the second jaw sections 41*d* and 42*d*.

Thus in this embodiment the resilient material 44*a*, 43*a*, 44*b* and 43*b* provide hinged couplings which lie parallel to the axis of the elongate body 40.

In all of the embodiments described hereinabove the hair clip can be made of any suitable material such as a decorative plastic material, or metal such as gold or silver when the hair clip is a jewellery item. The resilient members or springs can be formed of any suitable material, such as spring metal or spring plastic, that provides a spring force between the jaws and the body to urge the jaws to the closed position. The hair clip can be of any length and need not be elongate. Also, it is possible to attach false hair to the clip to enable the wearer to wear the clip and have extended hair.

Although the present invention has been described with reference to specific embodiments, it will be apparent to a skilled person in the art that modifications lie within the spirit and scope of the present invention.

What is claimed is:

1. A hair clip comprising a body portion; jaw portions attached to said body portion; and a jaw opening arrangement to allow said jaw portions to be opened single handed; said jaw portions having tines and being hingedly and resiliently connected to said body portion to urge said tines together for gripping hair, wherein said jaw portions are connected to said body portion at hinge positions defining laterally spaced axes, said jaw opening arrangement comprises handle portions extending from said jaw portions away from said tines to allow said jaw portions to be opened by urging said handle portions about said axes and said body portion defines a space therein for receiving hair gripped by said tines.

2. A hair clip according to claim 1, wherein said body portion has an outer face and said jaw portions are hingedly connected to said body portion at a position away from said outer face.

3. A hair clip according to claim 1, including resilient portions arranged between said body portion and said jaw portions to provide said resilient connection between said body portion and said jaw portions.

4. A hair clip according to claim 3, wherein said jaw portions are mounted to said body portion via pivot pins, and said resilient portions comprise spring members engaging said body portion and said jaw portions.

5. A hair clip according to claim 3, wherein said body portion and said jaw portions are formed from a single piece of material thinned at said hinge positions to enable the relative pivoting of said jaw portions and said body portion, and said resilient portions comprise resilient members engaging said jaw portions and said body portion.

6. A hair clip according to claim 3, wherein said resilient portions comprise resilient material connecting said jaw portions and said body portion.

7. A hair clip according to claim 1, wherein said jaw portions are arcuate in section to define a volume between said body portion and said jaw portions into which hair can be clasped in use.

8. A hair clip according to claim 1, wherein each said jaw portion comprises a plurality of hingedly and resiliently coupled jaw sections, each axis of the hinged couplings lying parallel to said laterally spaced axes.

9. A hair clip according to claim 1, wherein said body portion is substantially arcuate in section.

10. A hair clip according to claim 9, wherein said hair clip has a substantially cylindrical form.

11. A hair clip according to claim 10, wherein said jaw portions are substantially arcuate in section.

12. A hair clip according to claim 1, wherein said hair clip has a substantially cylindrical form.

13. A hair clip according to claim 12, wherein said jaw portions are substantially arcuate in section.

14. A hair clip comprising a body portion; jaw portions attached to said body portion; and a jaw opening arrangement to allow said jaw portions to be opened single handed; said jaw portions having tines and being hingedly and resiliently connected to said body portion to urge said tines together for gripping hair, wherein said jaw portions are connected to said body portion at hinge positions defining laterally spaced axes, and said body portion has thin section edge portions defining a large aperture between said axes, to allow hair of a wearer to be seen therethrough when worn.

15. A hair clip comprising a body portion; jaw portions attached to said body portion; and a jaw opening arrangement to allow said jaw portions to be opened single handed; said jaw portions having tines and being hingedly and resiliently connected to said body portion to urge said tines together for gripping hair, wherein said jaw portions are connected to said body portion at hinge positions defining laterally spaced axes, said body portion comprises a base portion to which said jaw portions are connected and at least one decorative cover portion, and at least one said decorative cover portion is removable in use to enable different cover portions to be connected to said base portion.

16. A hair clasp comprising opposed jaws having teeth arranged to meet to clasp hair, a jaw opening arrangement extending away from said jaws and for opening the jaws single handed, and a mount arrangement on which said jaws are resiliently mounted at two or more laterally spaced pivot axes, wherein said mount arrangement defines a concave space into which hair is received when gripped by said jaws.

17. A hair clip comprising jaw means having teeth arranged to meet to grip hair, jaw opening means extending away from said jaw means and for opening said jaw means single handed, and a mount means on which said jaw means are mounted so as to be resiliently pivoted about at least two laterally spaced axes, wherein said mount means defines a concave space into which hair is received when gripped by said jaw means.

18. A hair clip according to claim 17, wherein said mount means comprises a mount body, and said jaw means comprises opposed jaw arrangements pivotably and resiliently mounted on said mount body.

19. A hair clip according to claim 18, wherein said mount means has an outer face and said jaw means are pivotable mounted on said mount means at a position away from said outer face.

20. A hair clip comprising a body portion; jaw portions attached to said body portion; and a jaw opening arrangement to allow said jaw portions to be opened single handed; wherein said jaw portions have tines and are hingedly and resiliently connected to said body portion to urge said tines together to a closed position for gripping hair, said jaw portions are connected to said body portion at hinge positions defining laterally spaced hinge axes, and said jaw portions and said body define an outer hair clip surface which is substantially cylindrical when said jaw portions are in the closed position.

21. A hair clip according to claim 20, wherein said tines are arranged to meet substantially in a plane when said jaw portions are in the closed position.

22. A hair clip according to claim 21, wherein said tines are arranged to meet interdigitatedly.

23. A hair clip according to claim 20, wherein said jaw portions are hingedly connected to said body portion at a position away from said outer face.

24. A hair clip according to claim 20, wherein said jaw opening arrangement comprises handle portions extending from said jaw portions away from said tines to allow said jaw portions to be opened by urging said handle portions about said axes.

25. A hair clip according to claim 20, wherein said jaw opening arrangement comprises a jaw engagement portion arranged within said jaws portions and operable in a direction of said hinge axes to engage said jaw portions to urge said jaw portions open.

26. A hair clip according to claim 25, wherein said jaw engagement portion has angled engagement surfaces for engagement with said jaw portions to urge said jaw portions open.

27. A hair clip according to claim 25, wherein said jaw engagement portion is carried by said body portion.

28. A hair clip according to claim 27, wherein said jaw engagement portion is slidably attached to said body portion to allow said jaw engagement portion to slide relative to said body portion to engage said jaw portions.

29. A hair clip according to claim 20, including resilient portions arranged between said body portion and said jaw portions to provide said resilient connection between said body portion and said jaw portions.

30. A hair clip according to claim 29, wherein said jaw portions are mounted to said body portion via pivot pins, and said resilient portions comprise spring members engaging said body portion and said jaw portions.

31. A hair clip according to claim 30, wherein said body portion and said jaw portions are formed from a single piece of material thinned at said hinge positions to enable the relative pivoting of said jaw portions and said body portion, and said resilient portions comprise resilient members engaging said jaw portions and said body portion.

32. A hair clip according to claim 31, wherein said resilient portions comprise resilient material connecting said jaw portions and said body portion.

33. A hair clip according to claim 20, wherein said body portion comprises a base portion to which said jaw portions are connected, and at least one decorative cover portion.

34. A hair clip according to claim 33, wherein at least one said decorative cover portion is removable in use to enable different cover portions to be connected to said base portion.

35. A hair clip according to claim 20, wherein said body portion has thin section edge portions defining a large aperture between said axes, to allow hair of a wearer to be seen therethrough when worn.

36. A hair clip according to claim 20, wherein said jaw portions are arcuate in section to define a volume between said body portion and said jaw portions into which hair is clasped in use.

37. A hair clip according to claim 20, wherein each said jaw portion comprises a plurality of hingedly and resiliently coupled jaw sections, each axis of the hinged couplings lying parallel to said laterally spaced axes.

38. A hair clip comprising a body portion; jaw portions attached to said body portion; and a jaw opening arrangement to allow said jaw portions to be opened single handed; wherein said jaw portions have tines and are hingedly and resiliently connected to said body portion to urge said tines together to a closed position for gripping hair, said jaw portions are connected to said body portion at hinge positions defining laterally spaced hinge axes, and said tines are arranged to meet substantially in a plane when said jaw portions are in the closed position.

39. A hair clip according to claim 38, wherein said tines are arranged to meet interdigitatedly.

40. A hair clip comprising a body portion extending along an axis; jaw portions attached to said body portion, said jaw portions having tines and being hingedly and resiliently connected to said body portion to urge said tines together to a closed position for gripping hair, and said jaw portions being connected to said body portion at hinge positions defining laterally spaced hinge axes parallel to said axis; a jaw opening arrangement to allow said jaw portions to be opened single handed; and cover portions extending from said jaw portions to cover at least a portion of the gaps between said body portion and said jaw portions and arranged to move under or over said body portion when said jaw portions are opened.

41. A hair clip according to claim 40, wherein said body portion has an outer face and said jaw portions are hingedly connected to said body portion at a position away from said outer face.

42. A hair clip according to claims 41, including hinge cover portions for covering the hinged resilient connections between said jaw portions and said body portion and arranged to move under or over said body portion when said jaw portions are opened.

43. A hair clip according to claim 40, including hinge cover portions for covering the hinged resilient connections between said jaw portions and said body portion and arranged to move under or over said body portion when said jaw portions are opened.

44. A hair clip according to claim 40, wherein said jaw opening arrangement comprises handle portions extending from said jaw portions away from said tines to allow said jaw portions to be opened by urging said handle portions about said axes.

45. A hair clip according to claim 40, wherein said jaw opening arrangement comprises a jaw engagement portion arranged within said jaws portions and operable in a direction of said hinge axes to engage said jaw portions to urge said jaw portions open.

46. A hair clip according to claim 45, wherein said jaw engagement portion has angled engagement surfaces for engagement with said jaw portions to urge said jaw portions open.

47. A hair clip according to claim 45, wherein said jaw engagement portion is by said body portion.

48. A hair clip according to claim 43, wherein said jaw engagement portion is slidably attached to said body portion to allow said jaw engagement portion to slide relative to said body portion to engage said jaw portions.

49. A hair clip according to claim 40, including resilient portions arranged between said body portion and said jaw portions to provide said resilient connection between said body portion and said jaw portions.

50. A hair clip according to claim 49, wherein said jaw portions are mounted to said body portion via pivot pins, and said resilient portions comprise spring members engaging said body portion and said jaw portions.

51. A hair clip according to claim 49, wherein said body portion and said jaw portions are formed from a single piece of material thinned at said hinge positions to enable the relative pivoting of said jaw portions and said body portion, and said resilient portions comprise resilient members engaging said jaw portions and said body portion.

52. A hair clip according to claim 49, wherein said resilient portions comprise resilient material connecting said jaw portions and said body portion.

53. A hair clip according to claim 40, wherein said body portion comprises a base portion to which said jaw portions are connected, and at least one decorative cover portion.

54. A hair clip according to claim 53, wherein at least one said decorative cover portion is removable in use to enable different cover portions to be connected to said base portion.

55. A hair clip according to claim 40, wherein said body portion has thin section edge portions defining a large aperture between said axes, to allow hair of a wearer to be seen therethrough when worn.

56. A hair clip according to claim 40, wherein said jaw portions are arcuate in section to define a volume between said body portion and said jaw portions into which hair can be clasped in use.

57. A hair clip according to claim 40, wherein each said jaw portion comprises a plurality of hingedly and resiliently coupled jaw sections, each axis of the hinged couplings lying parallel to said laterally spaced hinge axes.

58. A hair clip comprising a body portion extending along an axis; jaw portions attached to said body portion, said jaw portions having tines and being hingedly and resiliently connected to said body portion to urge said tines together to a closed position for gripping hair, and said jaw portions being connected to said body portion at hinge positions defining laterally spaced hinge axes parallel to said axis; a jaw opening arrangement to allow said jaw portions to be opened single handed; and hinge cover portions for covering the hinged resilient connections between said jaw portions and said body portion and arranged to move under or over said body portion when said jaw portions are opened.

59. A hair clip according to claim 58, wherein said body portion has an outer face and said jaw portions are hingedly connected to said body portion at a position away from said outer face.

60. A hair clip according to claim 58, wherein said jaw opening arrangement comprises handle portions extending from said jaw portions away from said tines to allow said jaws to be opened by urging said handle portions about said axes.

61. A hair clip according to claim 58, wherein said jaw opening arrangement comprises a jaw engagement portion arranged within said jaws portions and operable in a direction of said hinge axes to engage said jaw portions to urge said jaw portions open.

62. A hair clip according to claim 61, wherein said jaw engagement portion has angled engagement surfaces for engagement with said jaw portions to urge said jaw portions open.

63. A hair clip according to claim 61, wherein said jaw engagement portion is carried by said body portion.

64. A hair clip according to claim 63, wherein said jaw engagement portion is slidably attached to said body portion to allow said jaw engagement portion to slide relative to said body portion to engage said jaw portions.

65. A hair clip according to claim 58, including resilient portions arranged between said body portion and said jaw portions to provide said resilient connection between said body portion and said jaw portions.

66. A hair clip according to claim 65, wherein said jaw portions are mounted to said body portion via pivot pins, and said resilient portions comprise spring members engaging said body portion and said jaw portions.

67. A hair clip according to claim 65, wherein said body portion and said jaw portions are formed from a single piece of material thinned at said hinge positions to enable the relative pivoting of said jaw portions and said body portion, and said resilient portions comprise resilient members engaging said jaw portions and said body portion.

68. A hair clip according to claim 65, wherein said resilient portions comprise resilient material connecting said jaw portions and said body portion.

69. A hair clip according to claim 58, wherein said body portion comprises a base portion to which said jaw portions are connected, and at least one decorative cover portion.

70. A hair clip according to claim 69, wherein at least one said decorative cover portion is removable in use to enable different cover portions to be connected to said base portion.

71. A hair clip according to claim 58, wherein said body portion has thin section edge portions defining a large aperture between said axes, to allow hair of a wearer to be seen therethrough when worn.

72. A hair clip according to claim 58, wherein said jaw portions are arcuate in section to define a volume between said body portion and said jaw portions into which hair can be clasped in use.

73. A hair clip according to claim 58, wherein each said jaw portion comprises a plurality of hingedly and resiliently coupled jaw sections, each axis of the hinged couplings lying parallel to said laterally spaced axes.

* * * * *